US011964785B2

(12) United States Patent
Armeni et al.

(10) Patent No.: US 11,964,785 B2
(45) Date of Patent: Apr. 23, 2024

(54) PACK FOR SMOKING PRODUCTS

(71) Applicant: G.D S.p.A., Bologna (IT)

(72) Inventors: Alan Armeni, Bologna (IT); Davide Parazza, Bologna (IT); Giuliano Gamberini, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 17/851,104

(22) Filed: Jun. 28, 2022

(65) Prior Publication Data

US 2022/0411113 A1 Dec. 29, 2022

(30) Foreign Application Priority Data

Jun. 29, 2021 (IT) ..... 102021000016982

(51) Int. Cl.
*B65B 13/02* (2006.01)
*B65B 13/04* (2006.01)
*B65B 13/32* (2006.01)

(52) U.S. Cl.
CPC ..... *B65B 13/04* (2013.01); *B65B 13/32* (2013.01)

(58) Field of Classification Search
CPC ..... B65B 13/04; B65B 13/02; B65B 13/32; B65B 13/00; B65D 63/10
See application file for complete search history.

(56) References Cited

U.S. PATENT DOCUMENTS 2,605,897 A * 8/1952 Rundle ..... B65D 75/5844 206/264
7,503,153 B2 * 3/2009 De Matteis ..... B65B 25/14 53/223
8,046,978 B2 * 11/2011 Pipes ..... B65B 35/52 53/399
2014/0075885 A1 * 3/2014 Perl ..... B65B 27/04 53/399
2022/0396416 A1 * 12/2022 Hodges ..... B65D 63/1009
2023/0182942 A1 * 6/2023 Köster ..... B65D 63/1009 53/148

FOREIGN PATENT DOCUMENTS

| | | |
|---|---|---|
| DE | 6923785 | 10/1969 |
| EP | 2305563 A2 | 4/2011 |
| WO | 9506603 A1 | 3/1995 |
| WO | 2021094738 A1 | 5/2021 |
| WO | 2021239625 A1 | 12/2021 |

OTHER PUBLICATIONS

Italian Search Report dated Mar. 14, 2022. 9 pages.

* cited by examiner

*Primary Examiner* — Andrew M Tecco
(74) *Attorney, Agent, or Firm* — RMCK Law Group PLC

(57) ABSTRACT

A method is described for making a pack of smoking products having an ordered group of packets containing smoking products and positioned in contact with each other, wherein the group of packets has a closed lateral surface around a theoretical axis of the group of packets, which delimits two opposite surfaces of the group of packets, each of which surfaces is defined by the set of homologous surfaces of all the packets. The method includes unwinding from a reel at least one adhesive tape and applying it to the closed lateral surface and completely around the latter, to hold the packets of the group together solely by means of the at least one adhesive tape.

10 Claims, 10 Drawing Sheets

PACK FOR SMOKING PRODUCTS

CROSS-REFERENCE TO RELATED APPLICATION

This application claims priority to Italian Patent Application No. 102021000016982 filed Jun. 29, 2021. The disclosure of the above application is incorporated herein by reference in its entirety.

TECHNICAL FIELD

The present invention relates to a novel pack for smoking products. The pack described here belongs to the type of packs that comprise an ordered group of packets containing smoking products, positioned in contact with each other. For example, multiple packs of cigarettes (called "cartons" in the language of the trade) belong to this type.

BACKGROUND

A widespread known solution for packs of this type provides a container made of cardboard, in which an ordered group of packets is received, and an outer wrapper of plastic material which is wrapped completely round the container.

Another known solution which is equally widespread provides only an outer wrapper of plastic material which is wrapped directly around the ordered group of packets.

Solutions for making packs of the type in question with the aim of reducing the amount of material used, for a lower environmental impact, have also been proposed in the prior art. In this connection, the document WO2014 053515 A1 illustrates a solution in which a sheet of heat shrink film wraps the group of packets and presses them against each other to hold them together. On the other hand, the document DE29518315U1 illustrates a pack composed of a base and an upper cover, between which the group of packets is received, and a series of bands for holding the base and the upper cover together.

OBJECT AND SUMMARY

In this context, the present invention is also intended to resolve the problem of reducing the amount of material used, by presenting a solution which is an improvement on the known solutions discussed above in various respects, including a further reduction in the amount of material used and a simplification of the corresponding production method.

The present invention relates in a general way to a packaging method according to claim 1.

The present invention also relates to a machine according to claim 6 and a pack according to claim 9.

The claims form an integral part of the teachings provided here.

BRIEF DESCRIPTION OF THE DRAWINGS

Further characteristics and advantages of the invention will be apparent from the following description, which refers to the attached drawings provided purely by way of non-limiting example, in which.

DESCRIPTION

The following description illustrates various specific details intended to provide a deeper understanding of the embodiments. The embodiments may be realized without one or more of the specific details, or with other methods, components or materials, etc. In other cases, known structures, materials or operations are not shown or described in detail, to avoid obscuring various aspects of the embodiment.

The references used here are purely for convenience and therefore do not define the scope of protection or the extent of the embodiments.

As mentioned above, the pack described here is a pack for smoking products, and, in particular, belongs to the type of packs comprising an ordered group of packets containing smoking products and positioned in contact with each other.

It should be noted that reference will be made in the present text to the specific example of "cigarettes" rather than to the more generic expression "smoking products", without any loss of generality in relation to other types of products (such as cigars, mini cigars or cigarillos, electronic cigarettes or e-cigs, auxiliary products such as filters, refills for e-cigs and other products based on tobacco or on components that are alternatives to, or replacements of, tobacco).

The pack described here has been devised specifically for making multiple packs of cigarette packets, and reference is made below to this specific application. In all cases, the teachings provided here may also be used for making other types of packs.

Figure 3:
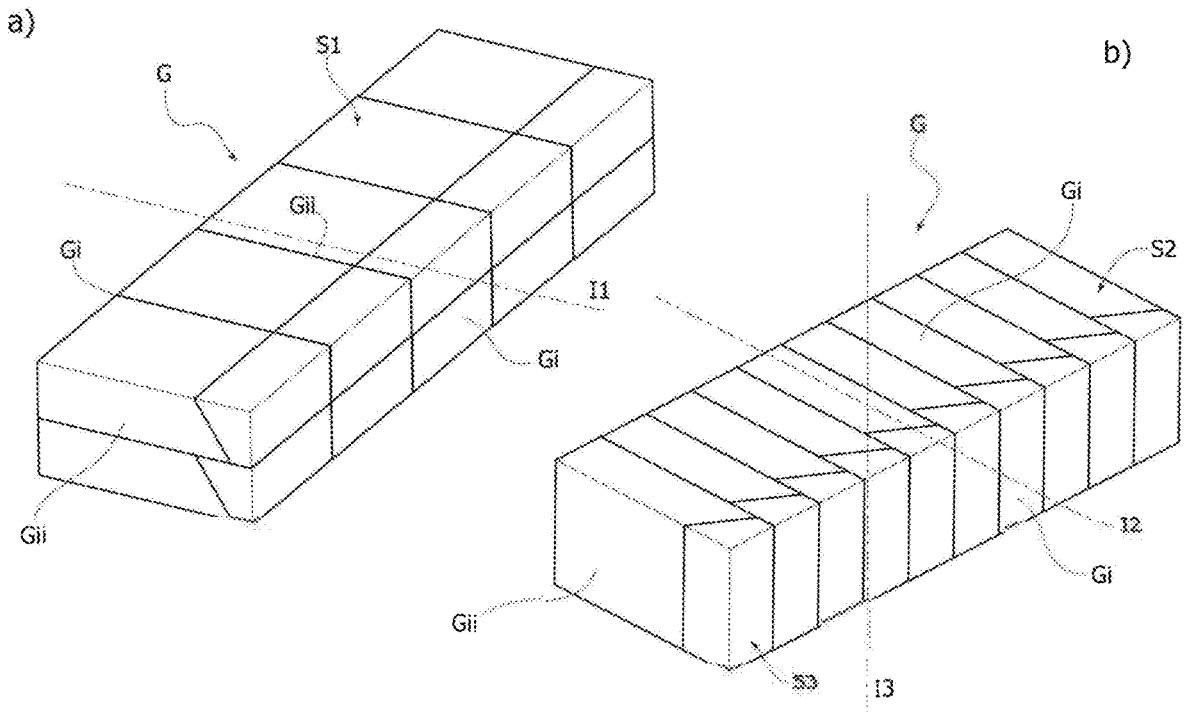
FIGS. 3*a* and 3*b* show two examples of ordered groups of packets.

With reference now to FIG. 3, this shows two examples of groups of packets G that are commonly provided in multiple packs of cigarette packets In each example, the combination of the packets P forms a parallelepiped. The sides or lateral surfaces Gi of the parallelepiped are defined by the corresponding faces of all the packets that make up the group. On the other hand, the sides Gii are defined by the corresponding faces of a subset of packets of the group G.

The group of packets G of view a) is formed by pairs of packets side by side and in contact, which are arranged in series and in mutual contact; in the illustrated example, the packets of a single pair are in contact on their respective major faces, although they could alternatively be placed in contact on their respective minor faces.

The group of packets G of view b), on the other hand, is formed by individual packets arranged in series and in mutual contact; in the illustrated example, the individual packets are in contact on their respective major faces, although they could alternatively be placed in contact on their respective minor faces.

In relation to the following description, a person skilled in the art will understand that, in general, the solution described here has been devised particularly for groups of packets characterized by packet formations of the 1×n or 2×n type, as indicated above for example.

Returning to FIG. 3, as a general rule, in the parallelepiped formed by the group of packets G in each example, it is possible to identify a closed lateral surface of tubular shape that delimits two opposite lateral surfaces Gi. In the example of image A) of FIG. 3, the lateral surface in question, indicated by the reference S1, is unique and is formed by the four sides Gii of the group of packets G (these sides are denoted below by the references G1, G2, G3, G4 respectively). The surface S1 extends around a reference axis I1 of the group of packets G. On the other hand, in the example of image B) of FIG. 3, there are two of the closed lateral surfaces of the aforementioned type, namely the surfaces S2 and S3, of which the first is formed by the two sides Gii and the two sides Gi defined by the opposite lateral edges of the individual packets, while the second is formed by the two sides Gii and the two sides Gi defined by the upper and lower faces of the individual packets. The surface S2 extends around a reference axis 12 of the group of packets G, and the surface S3 extends around a reference axis 13 of the group of packets G, which is orthogonal to the reference axis 12.

Incidentally, it should be noted that the examples provided are purely intended to facilitate the understanding of the solution described here. As a general rule, the type of packets and the configuration of the group G formed from them are not to be interpreted as in any way limiting on the scope of application of the solution.

Figure 1:
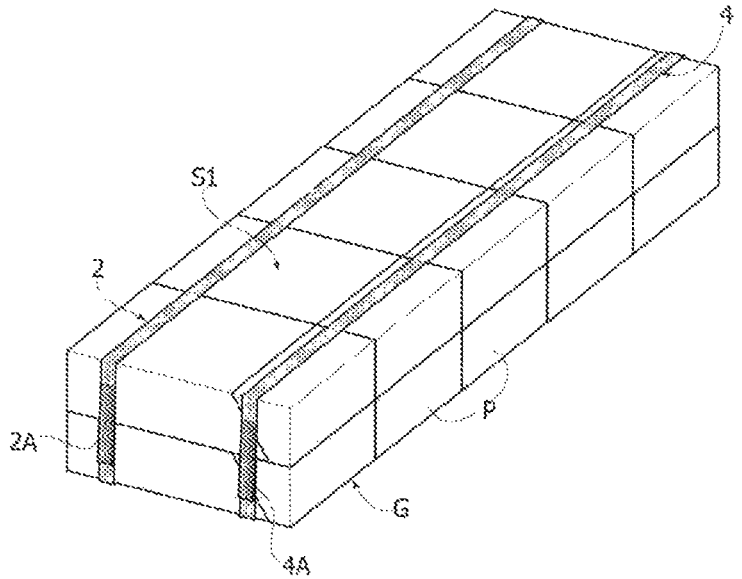
FIG. 1 shows a preferred embodiment of the pack described here.

With reference to FIG. 1, this shows a preferred embodiment of the pack described here, indicated as a whole by the reference numeral 10.

The pack 10 comprises a group G of packets P having a configuration corresponding to that shown in drawing A of FIG. 3.

According to an important characteristic of the solution described here, the pack 10 comprises an adhesive tape 2, applied to the closed lateral surface S1 of the group of packets G, which is wrapped completely around the latter, and which, on its own, holds together the packets P of the group.

In preferred embodiments, such as that illustrated, the pack 10 further comprises a second adhesive tape 4, also applied to the closed lateral surface S1 and wrapped completely around it. Even more preferably, the adhesive tape 4 extends parallel to the first adhesive tape 2.

According to this preferred embodiment, it is only the two adhesive tapes 2 and 4 that hold the packets P of the group together.

Consequently, the pack described here is formed by the packets P and, additionally, the tape 2 or the tapes 2 and 4 only.

In preferred embodiments, such as that illustrated, the tape 2 and/or the tape 4 have respective opposite end tabs 2A and 4A that are superimposed on each other. Even more preferably, the opposite tabs 2A, 4A are superimposed over a length equal to at least half of the dimension of the group of packets G in the same direction.

In preferred embodiments, such as that illustrated, the tape 2 and/or the tape 4 have a width of less than 10 mm.

Preferably, the tapes 2, 4 are made of polymer material, even more preferably transparent or at least translucent polymer material, so that the underlying areas of the closed lateral surface S1 are kept visible. Preferably, the tapes 2, 4 are made of polypropylene. The inner sides of the two tapes are coated with a layer of adhesive material. This material may be of a known type commonly used in the relevant technical field.

The solution described here also relates to a method for making a pack of the aforementioned type, and a machine for the implementation of said method.

As a general rule, the method described here provides for unwinding the adhesive tape 2 or adhesive tapes 2, 4 from a reel and applying it/them to the closed lateral surface S1 of the group of packets G and completely around the latter, to hold the packets of the group together solely by means of the adhesive tape or the two adhesive tapes. Similarly, the machine described here provides a unit for moving the group of packets G and a unit for applying the adhesive tape 2 or the adhesive tapes 2, 4 to the closed lateral surface S1 of the group of packets G.

FIGS. 2A to 2H show successive steps of a preferred embodiment of the method described here, implemented by a preferred embodiment of the packaging machine described here.

For simplicity of description, the method will now be illustrated with reference to the application of a single adhesive tape, particularly the tape 2, but the same teachings may evidently also relate to the application of a second adhesive tape.

Figure 2A:
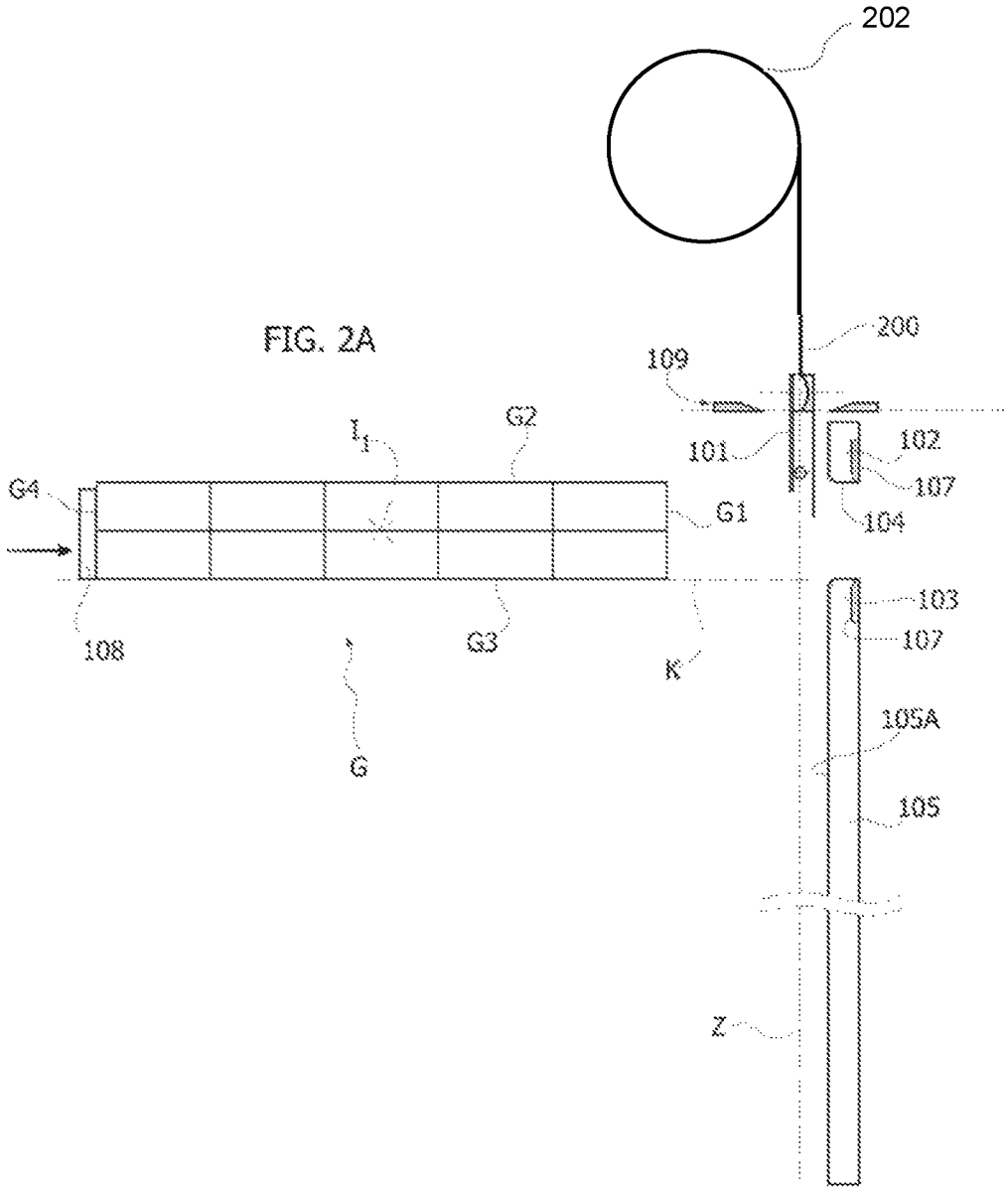
FIGS. 2A to 2H show successive steps of a preferred embodiment of the method described here.

With reference to FIG. 2A, the method described here provides, in the first place, for causing the group of packets G to advance in a direction of advance K, in an arrangement in which the theoretical axis I1 of the group of packets G is orthogonal to the direction of advance K; the faces G1, G2, G3, G4, parallel to the theoretical axis I1, which form the closed lateral surface S1, are arranged two by two, parallel to the direction of advance K or orthogonally thereto.

Preferably, the group of packets G is made to advance by means of a pushing member 108 (shown only in FIG. 2A).

A continuous adhesive tape 200 is unwound from a reel 202 (FIG. 2A) and fed in a direction of feed Z, orthogonally to the direction of advance K and to the theoretical axis I1 of the group of packets G.

Figure 2B:
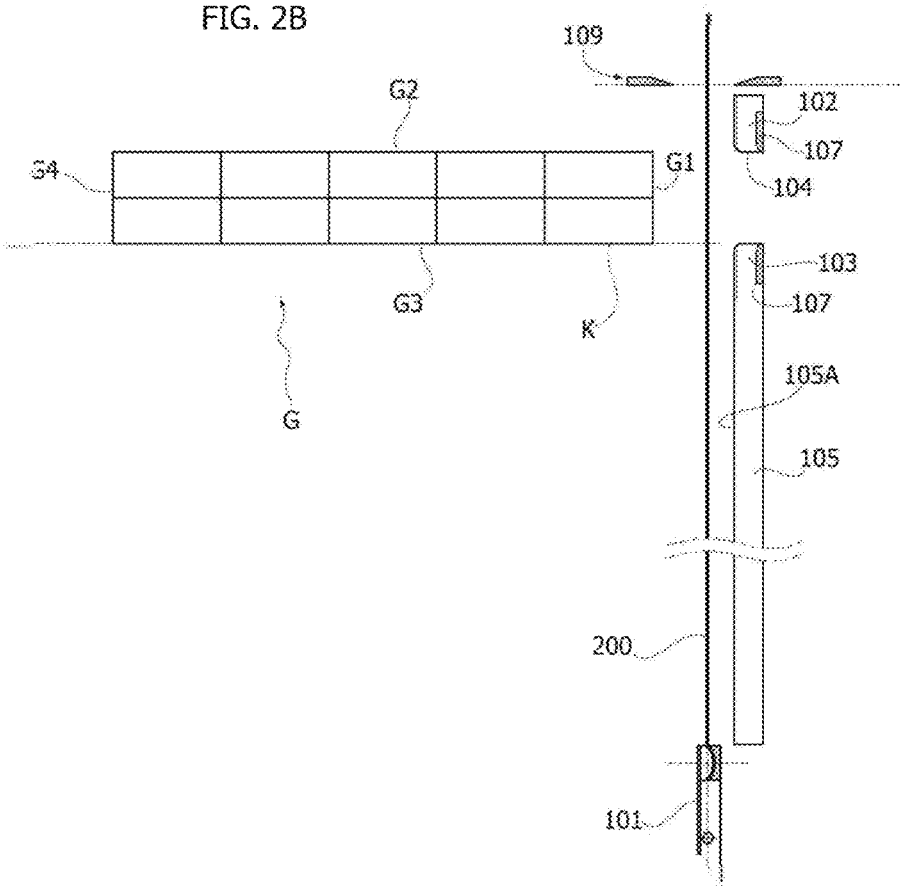

In one or more preferred embodiments, such as that illustrated, the tape 200 is moved in the direction of feed Z by means of a driving member 101, which grips the end tab 200A of the tape 200 and draws it with itself in the feed direction Z (FIG. 2B).

As a result of the action of the driving member 101, the adhesive tape 200 is positioned in front of a first face G1 of the lateral surface S1 of the group of packets G, with reference to the direction of advance K, and is interposed between the group of packets and a passage 104 which is defined by a first and a second stop element 102, 103, spaced apart from each other in the direction of feed Z.

For reasons which will be made clear by the following text, the tape 200 extends in the direction of feed Z beyond the passage 104 for a predetermined length, at least equal to the length of the face G2 of the lateral surface S1, preferably equal to about half of the perimeter of the lateral surface S1.

Figure 2C:
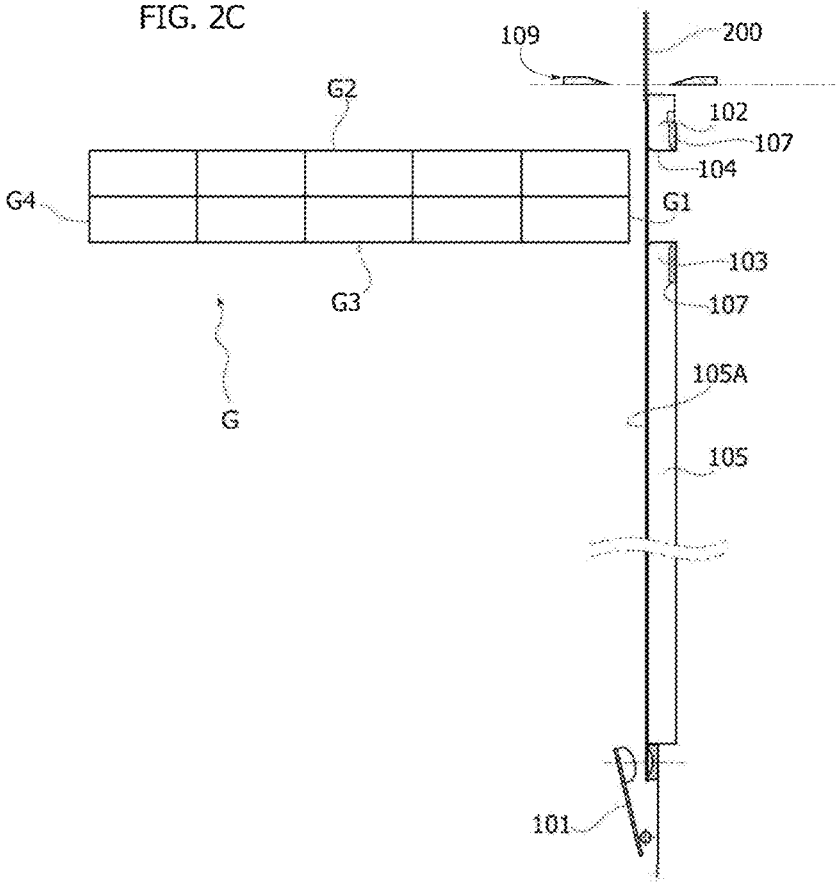

After the tape 200 has been fed in the direction of feed Z by the driving member 101, the two stop elements 102, 103 are brought into contact with said tape 200 (FIG. 2C).

In one or more preferred embodiments, such as that illustrated (see FIG. 2C), the portion of the tape 200 that extends in the direction of feed Z is engaged by a suction plate 105 so as to be retained on a plane containing the same direction of feed Z.

In one or more preferred embodiments, such as that illustrated, the suction plate 105 forms a single element that also defines the passage 104 and the two stop elements 102, 103 (the latter being identified by two opposite edges delimiting the passage 104).

The plate 105 can be moved with an alternating motion in the direction of advance K, between a position shown in FIG. 2C, in which its tape support surface 105A is coplanar with the direction of feed Z, and a position shown in FIG. 2A, in which the surface 105A is displaced downstream with reference to the direction of advance K.

The position of FIG. 2C is assumed in order to engage the tape 200 after it has been fed in the direction of feed Z, while the position of FIG. 2A is assumed when the driving member 101 moves in the direction Z, to avoid conditions of interference between the plate 105 and the driving member 101.

Figure 2D:
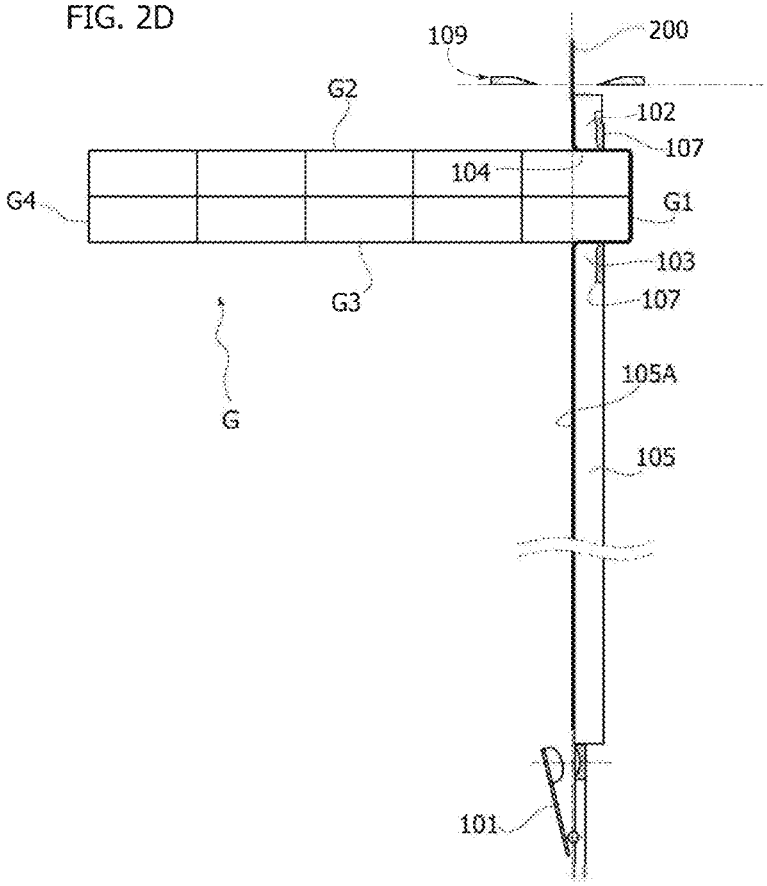
Figure 2E:
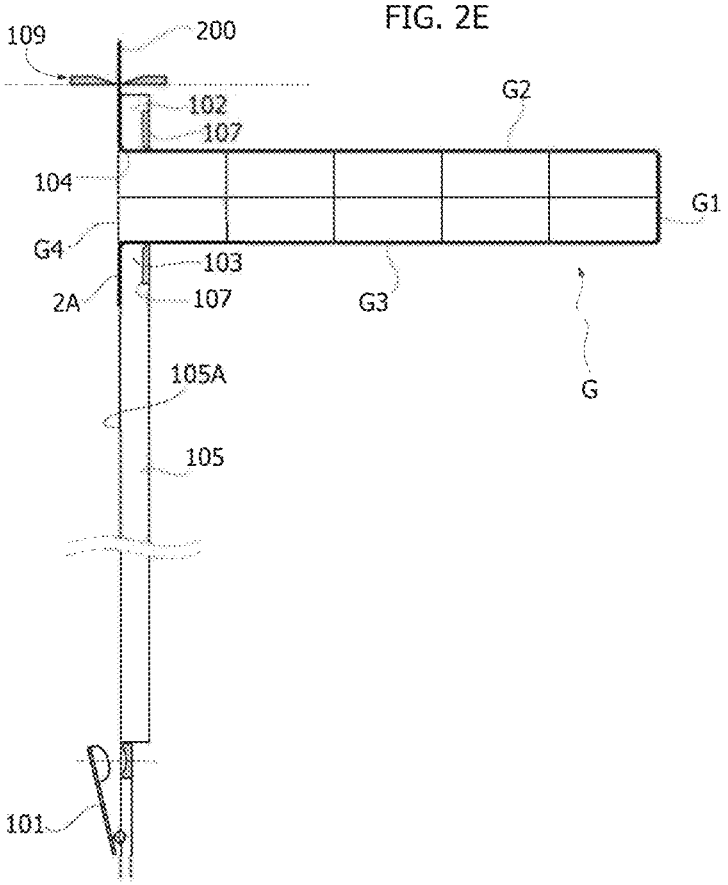

Returning to the method described here, after the stop elements 102, 103 have been brought into contact with the tape 200, the method provides for causing the group of packets G to advance in the direction of advance K, in order to bring it against the adhesive tape 200 positioned in front of it, and then in order to cause the group of packets G and the tape 200 engaged by it to advance through the passage 104 defined by the two stop elements 102, 103 (FIGS. 2D and 2E).

The relative movement between the group of packets G and the two stop elements 102, 103 causes a gradual folding of the tape 200 into a U-shape against the opposite faces G2, G3 of the closed lateral surface S1 of the group of packets G.

Preferably, the relative movement between the group of packets G and the two stop elements 102, 103 is halted when the face G4 of the group of packets G becomes aligned with the direction of feed Z of the tape 200 (FIG. 2E).

Figure 2F:
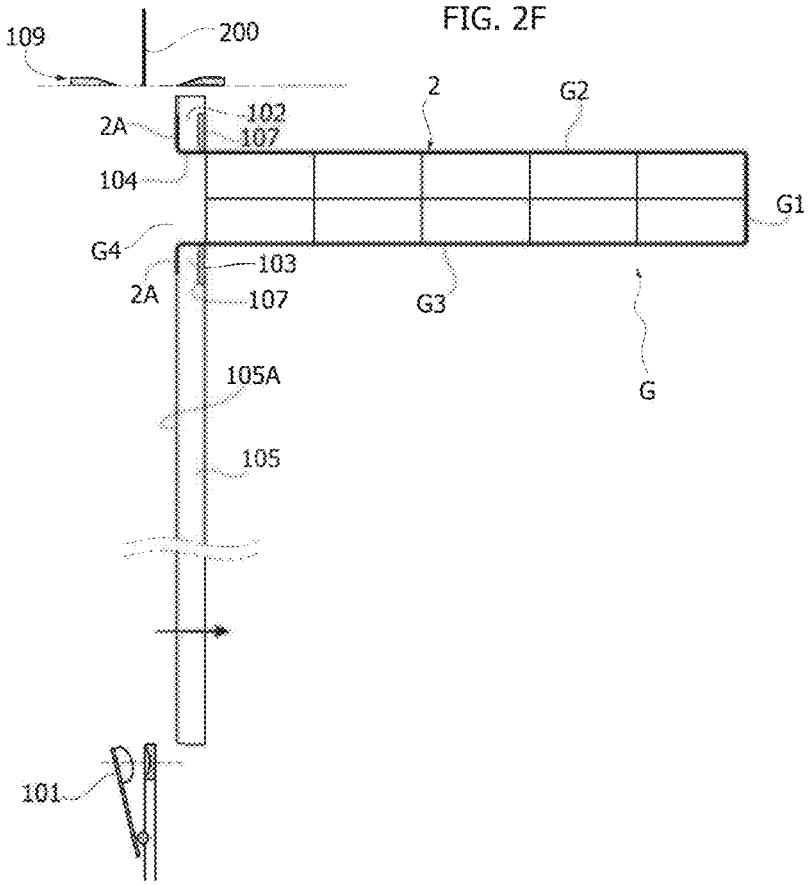

At this point, the method provides for cutting the tape 200 by means of a cutting member 109, in a position along the direction of feed Z which is upstream of the plate 105, in order to separate the adhesive tape 2 that is partially wrapped around the group of packets G from the continuous tape 200 (FIG. 2F). Evidently, the position in which the tape 200 is cut must be such as to provide a sufficient length of the adhesive tape 2 to completely close the tape 2 around the group of packets G.

The adhesive tape 2 separated from the continuous tape 200 is now folded in a U-shape around the group of packets G, and, preferably has two end tabs 2A extending beyond the faces G2, G3 of the group of packets and retained by corresponding portions of the plate 105 that are opposite each other with respect to the passage 104.

Figure 2G:
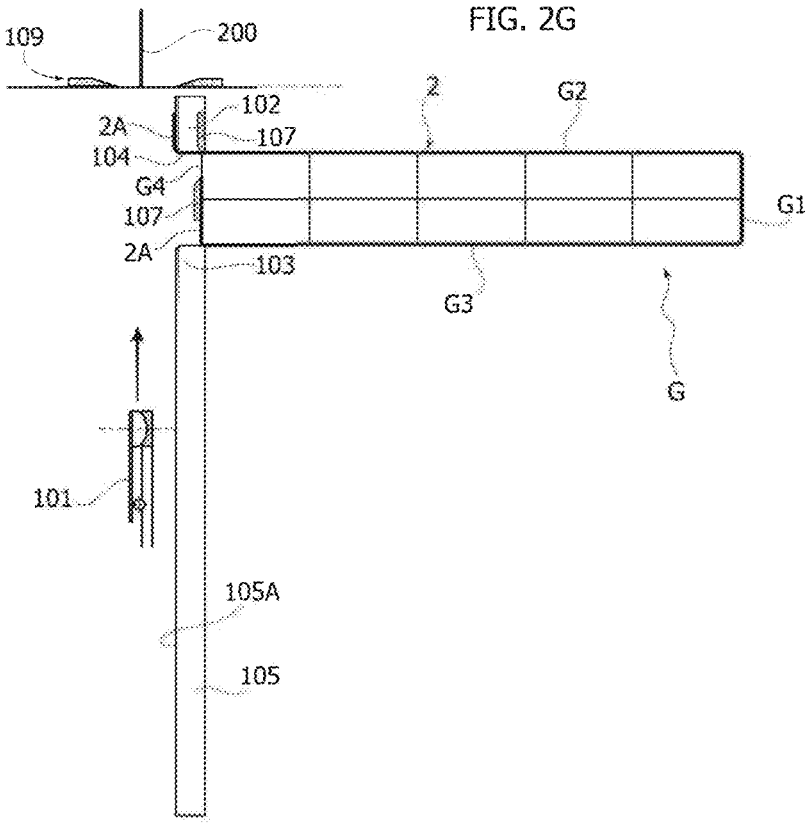
Figure 2H:
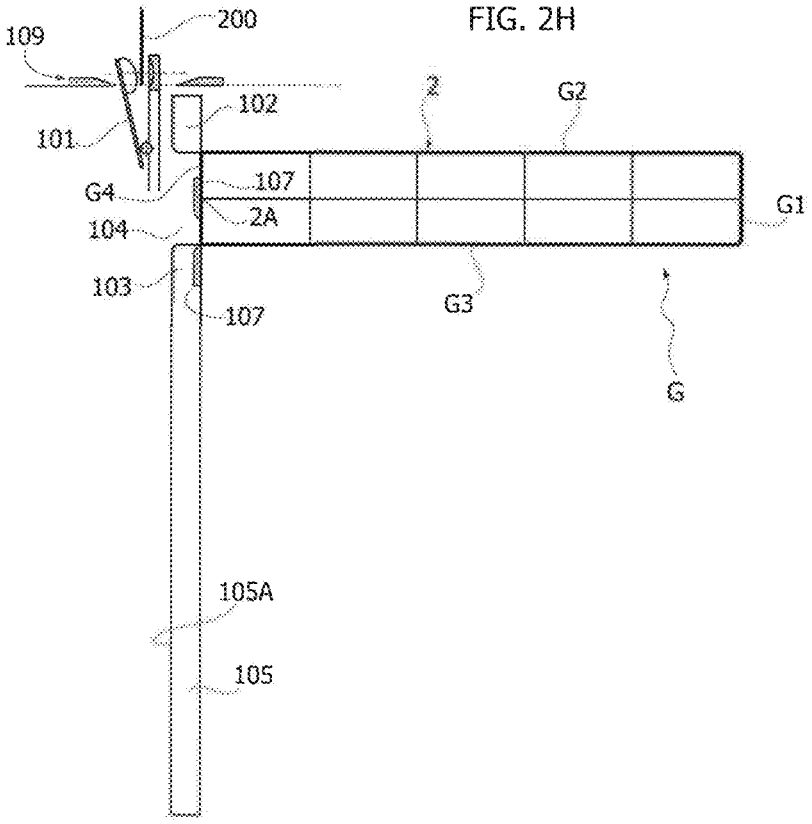

The method described here then provides for folding the two tabs 2A of the tape 2 against the face G4 of the group of packets so as to close the tape 2 completely around said group of packets (FIGS. 2G, 2H). As mentioned above, the length of the tabs 2A is preferably such that they are brought to a condition of mutual superimposition against the face G4 of the group of packets G.

For this purpose, in preferred embodiments, such as that illustrated, the plate 105 carries two folding members 107 which are positioned on opposite sides of the passage 104 and which are movable towards the inside of this passage and in the theoretical plane thereof, to engage the two opposite tabs 2A of the tape 2 and bring them against the face G4 of the group of packets.

Preferably, the two members 107 operate in succession so as to put the tabs 2A into the aforementioned condition of mutual superimposition (FIGS. 2G and 2H).

Before the two folding members 107 are activated, the group of packets G and the plate 105 are positioned in such a way that the sliding plane of the two folding members 107 is aligned with the face G4 of the group of packets G (FIG. 2F). Thus the movement of each folding member 107 creates an action that presses the tabs 2A against the face G4 of the group of packets.

Preferably, this mutual position between the group of packets G and the plate 105 is reached as a result of their simultaneous movement in the direction of advance K. In particular, as a result of this movement the plate 105 reaches the position of FIG. 2A; this is done in such a way that, while the two members 107 fold the tabs 2A of the tape, the driving member 101 is simultaneously free to move in the direction of feed Z in order to return to its position above the plate 105 to start a new cycle.

As mentioned above, the same method illustrated above may be used for applying the second adhesive tape 4 to the group of packets G. In particular, a second continuous adhesive tape may be unwound from a further reel and applied to the group of packets G by the same means, and according to the same procedure, as those illustrated above.

The same method illustrated above may also be used for applying at least one adhesive tape around the lateral surface S2 or S3 of the group of packets G illustrated in drawing B of FIG. 3; in particular, the group of packets will be orientated with its theoretical axis 12 orthogonal to the directions K and Z in order to wrap the adhesive tape around the lateral surface S2, or with its theoretical axis 13 orthogonal to the directions K and Z in order to wrap the adhesive tape around the lateral surface S3.

In view of the above it will be understood that the packaging machine according to the preferred embodiment illustrated above comprises a movement unit provided with the pushing member 108, and a tape application unit comprising the driving member 101, the suction plate 105 with the passage 104 and the two folding members 107, and the cutting member 109.

Clearly, provided that the principle of the invention is retained, the details of construction and forms of embodiment can be varied, even to a significant degree, from what has been illustrated herein purely by way of non-limiting example, without thereby departing from the scope of the invention, as defined in the attached claims. For example, in an alternative embodiment, the folding members of the projecting tabs of the tape may be entirely independent of the plate 105 and may be drivable with a motion which is rotary rather than translational. In other embodiments, the plate 105 may be removed and its function may be performed by the driving member 101 in an operating condition in which it retains the tab 200A of the tape and supports the movement of the latter during the folding of the tape around the group of packets G.

The invention claimed is:

1. A method for making a pack of smoking products comprising an ordered group of packets containing smoking products and positioned in contact with each other, wherein said group of packets has upper and lower opposed laterally extending surfaces and first and second opposed laterally extending side surfaces together forming a closed lateral surface around the group of packets, and around a laterally extending reference axis of the group of packets, which is positioned between the upper and lower opposed surfaces of the group of packets, each of the upper and lower surfaces is defined by a set of homologous surfaces of all packets of the group of packets, the method comprising:

unwinding at least one adhesive tape from a reel and applying it to the closed lateral surface of the group of packets and completely around the group of packets, to hold the packets of the group of packets together solely by means of the at least one adhesive tape, wherein unwinding the at least one adhesive tape from the reel and applying it to the closed lateral surface of the group of packets and completely around the group of packets includes:

causing the group of packets to advance in a direction of advance, in an arrangement in the laterally extending reference axis of the group of packets is orthogonal to the direction of advance;

feeding the at least one adhesive tape in a direction of feed orthogonal to the direction of advance and to the laterally extending reference axis of the group of packets;

positioning the at least one adhesive tape in front of the first laterally extending side surface of the closed lateral surface of the group of packets, with reference to the direction of advance of the group of packets, and in contact with a first and a second stop element spaced apart from each other along the direction of feed of the at least one adhesive tape, to define a passage for the group of packets;

causing the group of packets to advance in the direction of advance against the at least one adhesive tape positioned in front of the group of packets, and through the passage defined by the first and second stop elements, in such a way that the at least one adhesive tape is folded into a U-shape against the first laterally extending side surface and the upper and lower opposed laterally extending surfaces of the closed lateral surface of the group of packets, as a result of relative movement between the group of packets and the first and the second stop elements; and folding tabs of the at least one adhesive tape projecting from the upper and lower laterally extending surfaces, respectively, of the group of packets, against the second laterally extending surface of the closed lateral surface of the group of packets, placing the tabs in mutual superimposition, wherein:

feeding the at least one adhesive tape in the direction of feed includes causing the at least one adhesive tape to extend parallel to the direction of feed i) between the group of packets and the passage defined by the first and second stop elements, and ii) beyond said passage over a given length of adhesive tape, at least equal to a length of the upper or lower surfaces, of the closed lateral surface of the group of packets, and said method provides for retaining the given length of adhesive tape by means of a suction plate, the suction plate including a planar tape support surface extending above and below the opening and parallel to the direction of feed of the adhesive tape, the suction plate defining the stop elements, which define the passage.

2. The method according to claim 1, wherein feeding the at least one adhesive tape in the direction of feed includes driving the at least one adhesive tape in the direction of feed by means of a driving member.

3. The method according to claim 1, which includes unwinding from the reel at least one continuous adhesive tape including the at least one adhesive tape, and cutting the at least one continuous adhesive tape unwound from the reel, after the at least one adhesive tape has been folded in the U-shape, to separate the at least one adhesive tape from the at least one continuous adhesive tape unwound from the reel.

4. The method according to claim 1, wherein causing the group of packets to advance includes pushing the group of packets in the direction of advance by means of a pushing member.

5. The method according to claim 1, wherein folding the projecting tabs of the at least one adhesive tape includes causing a folding element, which engages the projecting tabs of the at least one adhesive tape, to slide along second laterally extending surface of the closed lateral surface of the group of packets.

6. A machine for implementing a packaging method according to claim 1, comprising:

a unit for moving a group of packets in a direction of advance, and an application unit for applying the at least one adhesive tape unwound from the reel to the closed lateral surface of the group of packets and completely around the group of packets, to hold the packets of the group of packets together solely by means of the at least one adhesive tape, wherein the application unit for applying the at least one adhesive tape comprises:

a member for driving the at least one adhesive tape, unwound from the reel, in the direction of feed of the at least one adhesive tape which is orthogonal to the direction of advance of the group of packets; and the first and the second stop elements arranged so as to be brought into contact with the at least one adhesive tape in the direction of feed, and are spaced apart from each other along a same direction, to define the passage for the group of packets moving in the direction of advance, wherein the unit for moving the group of packets comprises at least one pushing member which is movable in the direction of advance, for pushing the group of packets from a first position, in which it is upstream of the passage defined by the first and second stop elements, to a second position, in which it has at least partially passed through the passage defined by the first and second stop elements, the relative movement between the group of packets and the first and second stop elements causes the at least one adhesive tape to be folded into the U-shape around the closed lateral surface of the group of packets, and wherein the driving member for the at least one adhesive tape is movable in the direction of feed to cause the at least one adhesive tape to extend in the direction of feed between the group of packets in the first position and the passage defined by the first and second stop elements, and beyond said passage over the given length of adhesive tape, at least equal to the length of one surface of the closed lateral surface of the group of packets, parallel to the direction of advance of the group of packets, said machine including the suction plate for retaining at least the given length of adhesive tape.

7. The machine according to claim 6, wherein the application unit comprises a cutting member for separating the at least one adhesive tape from a continuous adhesive tape unwound from the reel, after the at least one adhesive tape has been folded in the U-shape around the closed lateral surface of the group of packets.

8. The machine according to claim 6, wherein the application unit comprises at least one folding member for folding at least one of the projecting tabs of the at least one adhesive tape folded in the U-shape around the closed lateral surface of the group of packets, in order to close the at least one adhesive tape completely around the closed lateral surface.

9. A pack of smoking products produced by the method according to claim 1, the pack of smoking products comprising:

the ordered group of packets containing smoking products and positioned in contact with each other, wherein said group of packets has the closed lateral surface around the laterally extending reference axis of the group of packets, which is positioned between the upper and lower opposed surfaces of the group of packets, each of the upper and lowed surfaces is defined by the set of homologous surfaces or sides of all the packets;

the at least one adhesive tape, which is applied to the closed lateral surface of the group of packets and wrapped completely around the group of packets, and which, on its own, holds together the packets of the group of packets.

10. The pack of smoking products according to claim 9, comprising a second adhesive tape, which is applied to the closed lateral surface of the group of packets and wrapped completely around the group of packets, and which extends parallel to the at least one adhesive tape applied to the closed lateral surface of the group of packets.

* * * * *